US008191322B2

(12) United States Patent
Liestenfeltz et al.

(10) Patent No.: US 8,191,322 B2
(45) Date of Patent: Jun. 5, 2012

(54) PAYLOAD MAST

(76) Inventors: Frank Liestenfeltz, Marion, IN (US); Kurt Liestenfeltz, Silver Spring, MD (US); Brian D. Gibson, Summitville, IN (US); Phillip D. Gibson, Fairmount, IN (US)

( * ) Notice: Subject to any disclaimer, the term of this patent is extended or adjusted under 35 U.S.C. 154(b) by 861 days.

(21) Appl. No.: 12/249,289

(22) Filed: Oct. 10, 2008

(65) Prior Publication Data

US 2012/0110927 A1 May 10, 2012

Related U.S. Application Data

(60) Provisional application No. 60/979,234, filed on Oct. 11, 2007.

(51) Int. Cl.
*E04H 12/18* (2006.01)
*E04H 12/34* (2006.01)

(52) U.S. Cl. ..... 52/212; 52/118; 52/632; 212/296; 248/125.2; 254/47

(58) Field of Classification Search ..... 52/118, 52/121, 632; 343/883, 901; 212/230, 264, 212/348, 296; 248/125.2, 492–494, 327, 248/332; 254/4 R, 4 B, 47, 335–338
See application file for complete search history.

(56) References Cited

U.S. PATENT DOCUMENTS

| | | | | | |
|---|---|---|---|---|---|
| 133,017 | A | * | 11/1872 | Davis | 52/121 |
| 326,336 | A | * | 9/1885 | Sandberg et al. | 212/264 |
| 2,675,211 | A | * | 4/1954 | Regoord | 254/387 |
| 2,795,303 | A | * | 6/1957 | Muehlhause et al. | 52/121 |
| 2,800,206 | A | * | 7/1957 | Thorpe | 52/118 |
| 2,966,956 | A | * | 1/1961 | Campbell et al. | 182/69.4 |
| 3,196,991 | A | * | 7/1965 | Johnson et al. | 52/115 |
| 3,213,574 | A | * | 10/1965 | Melbye et al. | 52/121 |
| 3,248,133 | A | * | 4/1966 | Michnoff | 285/148.18 |
| 3,328,921 | A | * | 7/1967 | Keslin | 52/121 |
| 3,638,806 | A | * | 2/1972 | Hippach | 212/231 |
| 3,861,647 | A | * | 1/1975 | Meredith | 254/4 R |
| 3,891,184 | A | * | 6/1975 | Fields | 254/4 R |
| 3,952,467 | A | * | 4/1976 | Partlow | 52/121 |
| 3,970,141 | A | * | 7/1976 | Raether | 165/47 |
| 4,151,534 | A | * | 4/1979 | Bond | 343/883 |
| 4,254,423 | A | * | 3/1981 | Reinhard | 343/883 |
| 4,258,825 | A | * | 3/1981 | Collins | 182/14 |
| 4,404,705 | A | * | 9/1983 | Thoma | 15/313 |
| 4,506,480 | A | * | 3/1985 | Murrill et al. | 52/121 |
| 4,508,316 | A | * | 4/1985 | Millard | 254/4 R |
| 4,580,377 | A | * | 4/1986 | Sundin | 52/121 |
| 4,600,348 | A | * | 7/1986 | Pettit | 414/11 |

(Continued)

FOREIGN PATENT DOCUMENTS

CA 2 097 774 * 12/1996

(Continued)

*Primary Examiner* — Robert Canfield
(74) *Attorney, Agent, or Firm* — Taylor IP, P.C.

(57) ABSTRACT

An extensible payload system including mounting equipment and a mast system removably coupled to the mounting equipment. The mast system includes a plurality of nested mast sections, at least one cable, and a pull block assembly. The plurality of nested mast sections include a first mast section and a second mast section nested within the first mast section. At least one cable is rollably coupled to the first mast section. The pull block assembly is coupled to an end of the second mast section. The pull block assembly has a cable receiving opening. The cable is routed into the cable receiving opening and is coupled to the pull block assembly.

16 Claims, 5 Drawing Sheets

U.S. PATENT DOCUMENTS

| | | | | | |
|---|---|---|---|---|---|
| 4,657,112 | A | * | 4/1987 | Ream et al. | 182/69.4 |
| 4,785,309 | A | * | 11/1988 | Gremillion | 343/883 |
| 5,052,645 | A | * | 10/1991 | Hixon | 248/125.2 |
| 5,060,427 | A | * | 10/1991 | Bernabe, Jr. | 52/118 |
| 5,101,215 | A | * | 3/1992 | Creaser, Jr. | 343/883 |
| 5,218,375 | A | * | 6/1993 | Hillman | 343/883 |
| 5,557,892 | A | | 9/1996 | Lavin | |
| 5,722,461 | A | * | 3/1998 | Lake | 138/35 |
| 6,041,558 | A | * | 3/2000 | Sylvestre | 52/111 |
| 6,046,706 | A | * | 4/2000 | Vargas | 343/883 |
| RE37,559 | E | * | 2/2002 | Marue et al. | 248/405 |
| 6,942,198 | B2 | * | 9/2005 | Huang | 254/387 |
| 7,195,216 | B2 | * | 3/2007 | Wang | 248/157 |
| 7,654,923 | B2 | * | 2/2010 | Bianchi et al. | 474/64 |
| 7,966,777 | B2 | * | 6/2011 | Douglas et al. | 52/118 |
| 2007/0028532 | A1 | * | 2/2007 | Douglas et al. | 52/118 |
| 2009/0288274 | A1 | * | 11/2009 | Narelli | 24/128 |

FOREIGN PATENT DOCUMENTS

| | | | | |
|---|---|---|---|---|
| DE | 26 20 458 | A1 | * | 11/1977 |
| DE | 195 34 311 | A1 | * | 3/1997 |
| DE | 196 36 959 | A1 | * | 3/1998 |
| EP | 0 039 963 | A1 | * | 11/1981 |
| EP | 0 696 826 | A1 | * | 2/1996 |
| EP | 2 213 845 | A1 | * | 11/2009 |
| FR | 2 633 000 | | * | 12/1989 |
| FR | 2 719 070 | | * | 10/1995 |
| FR | 2 837 109 | A1 | * | 9/2003 |
| SU | 1193116 | A | * | 11/1985 |

* cited by examiner

PAYLOAD MAST

CROSS REFERENCE TO RELATED APPLICATIONS

This is a non-provisional application based upon U.S. provisional patent application Ser. No. 60/979,234 also entitled "Payload Mast", filed Oct. 11, 2007, which is incorporated herein by reference.

BACKGROUND OF THE INVENTION

1. Field of the Invention

The present invention relates to a payload mast, and, more particularly, to a telescoping payload mast.

2. Description of the Related Art

Telescoping masts are utilized in commercial applications as well as in military and law enforcement scenarios. Telescoping masts are typically portable devices that are deployed as-needed from a stored position and then returned to stored, nested position when not in use. The telescoping mast can carry various payloads such as antennas, light arrangements, cameras, or various types of surveillance equipment. Telescoping masts may be operated pneumatically, hydraulically, or even by way of a chain drive. Pneumatic drive systems require airtight seals between the telescopic mast sections and typically require an air compressor on a vehicle in order to erect such a mast. Contaminants or ice deposits upon the mast sections or, more particularly, at the junctions of the mast sections may prevent the retraction of the mast and may even destroy the sealing mechanisms that exist between the mast sections. If the seal is destroyed, the entire mast system can collapse if the air system is not sufficient to overcome the loss of integrity of the seal.

Hydraulic systems for elevating the telescoping mast suffer from many of the same shortcomings. More particularly, hydraulic drives are generally relatively heavy and expensive to maintain and manufacture. The use of hydraulics for the mast assembly may require additional hydraulic capacity from the vehicle for the operation of the mast system in order to provide the necessary pressure and fluid flow to accommodate the extension of the mast.

Chain drives in telescoping mast systems are expensive to maintain and manufacture and are relatively heavy in weight. The chain link mechanism is typically exposed and is subject to damage and contamination.

What is needed in the art is a telescoping mast system that is easy to manufacture, maintain, and one that overcomes the environmental hazards to which such antennas are exposed.

SUMMARY OF THE INVENTION

The present invention provides an extensible payload system that can be utilized with a vehicle.

The invention consists in one form thereof, an extensible payload system including mounting equipment and a mast system removably coupled to the vehicle. The mast system includes a plurality of nested mast sections, at least one cable, and a pull block assembly. The plurality of nested mast sections include a first mast section and a second mast section nested within the first mast section. At least one cable is rollably coupled to the first mast section. The pull block assembly is coupled to an end of the second mast section. The pull block assembly has a cable receiving opening. The cable is routed into the cable receiving opening and is coupled to the pull block assembly.

The invention consists of, in another form thereof, a mast system including a plurality of nested mast sections, a cable, and a pull block assembly. The nested mast sections include a first mast section and a second mast section nested within the first mast section. The cable is rollably coupled to the first mast section. The pull block assembly is coupled to an end of the second mast section. The pull block assembly has a cable receiving opening into which the cable is routed. The cable is coupled to the pull block assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
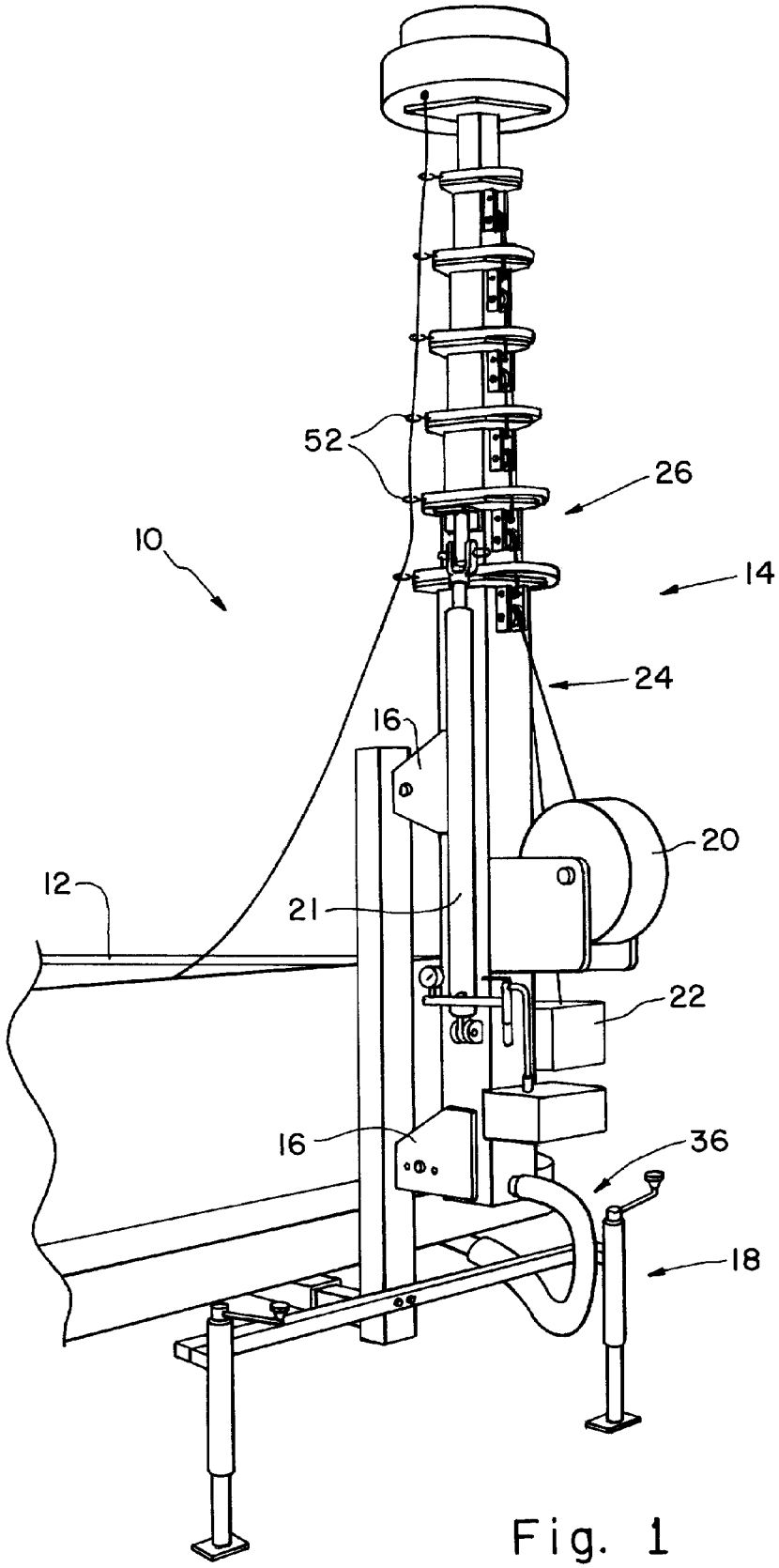
FIG. 1 is a perspective view of an embodiment of extensible mast system of the present invention, mounted to a vehicle.
Figure 2:
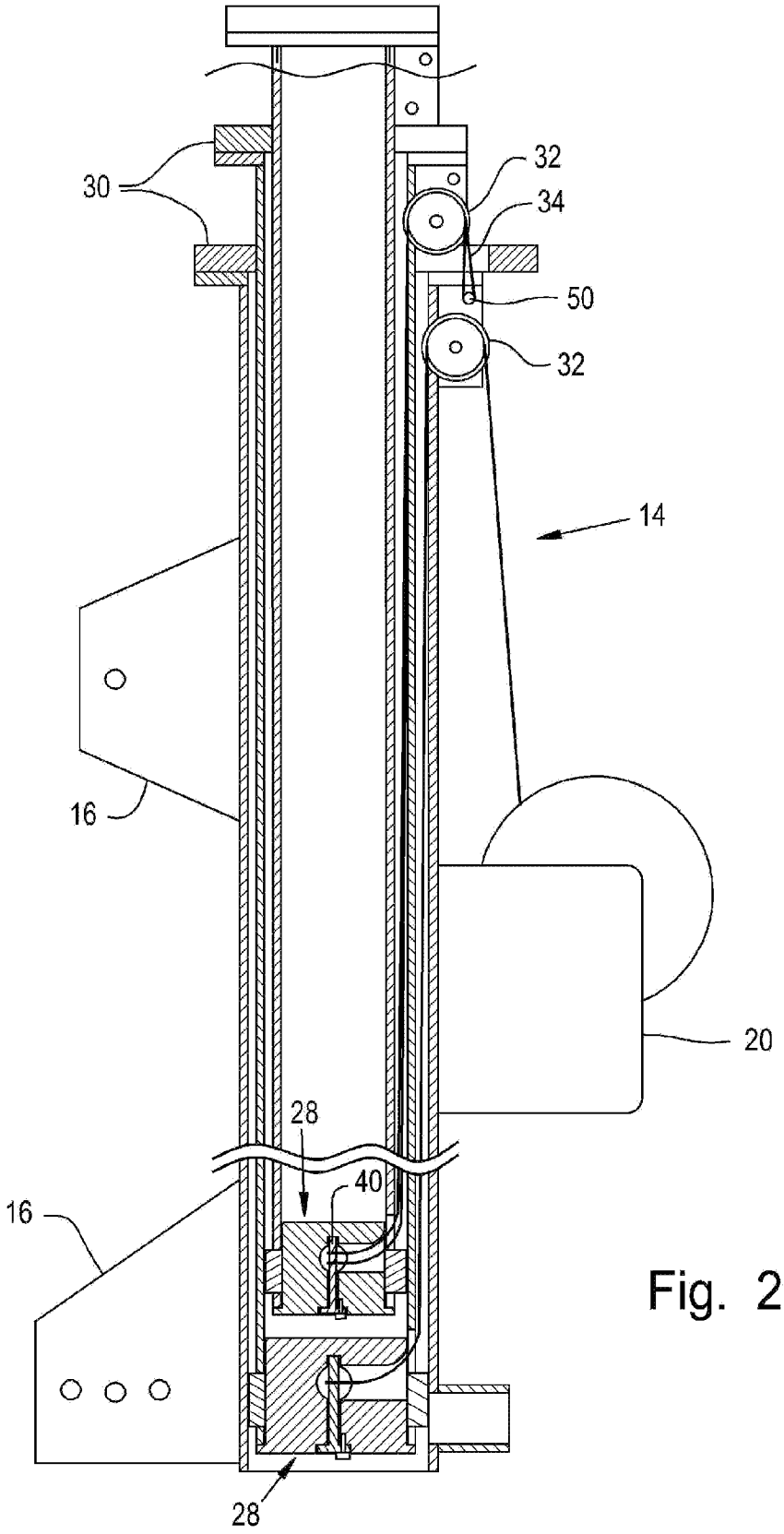
FIG. 2 is a partially sectioned view of the extensible mast system of FIG. 1.
Figure 3:
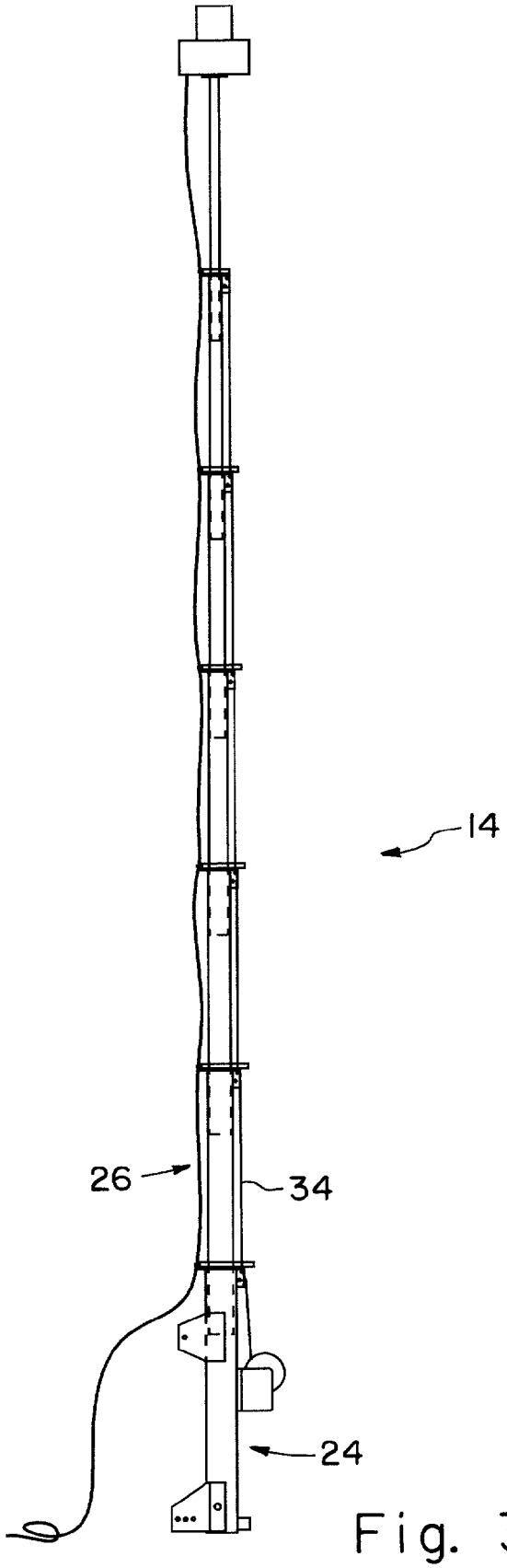
FIG. 3 is a side view of the extensible mast system of FIGS. 1 and 2 in a deployed extended position.

Referring now to the drawings, and more particularly to FIGS. 1-3, there is illustrated an extensible payload system 10 including mounting equipment 12 to which is attached a mast system 14. Mounting equipment 12 may include a vehicle 12 as illustrated in FIG. 1 for the sake of clarity, but may alternatively, for example, be a trailer, a wall of a building, a ground mount or a boat. Brackets 16 connect mast system 14 to stabilizing feature 18, illustrated here as an adjustable bipod connected to a hitch assembly of a vehicle 12. Although mast system 14 is illustrated as being connected to vehicle 12, mast system 14 can also be erected directly on the ground with other stabilizing features, such as guy wires attached to the bottom-most section and possibly the upper sections when mast system 14 is extended.

An erecting winch system 20, which may be electric or manual, pulls the cable that enters the bottom mast section. In addition to erecting winch system 20, a manual erecting system 22 is also utilized on another face of mast system 14. On another face of the mast is installed a redundancy cylinder system 21 acting as a shock or redundancy/safety system for rapid descent of mast system 14. In emergency situations when mast system 14 has to rapidly retract or re-nest cylinder system 21 can be used to buffer the decent by controlling the amount of fluid flow from the cylinder. On the face directly opposite cylinder system 21 is installed a second set of cables for back up if the main cables break in system 20. The cylinder (shock) system 21 and back-up cables act in unison as an anti-crash/safety system. Manual erecting system 22 uses a separate lower cable that enters the lower mast section. The motor of system 20 may be electrical, pneumatic, hydraulic or driven in some other powered manner.

Mast system 14 includes a mast section 24 and a mast section 26. Mast sections 24 and 26 are typical, particularly mast section 26 which illustrates the pattern of other sections nested therein. Although mast sections 24 and 26 are shown and illustrated as being made of square tubular material, other shapes are also contemplated to rectilinear, circular, triangular or other profile shapes. Except for mast section 24, each subsequent mast section, such as mast section 26, includes a pull block assembly 28.

Figure 4:
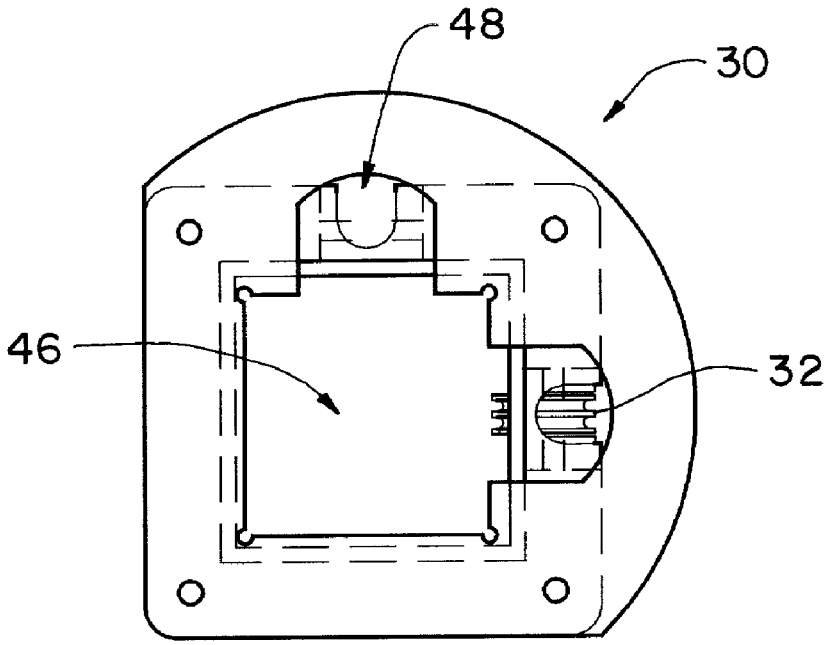
FIG. 4 is a top view of a typical mast section of the mast system of FIGS. 1-3 with some of the nested sections removed for clarity.
Figure 5:
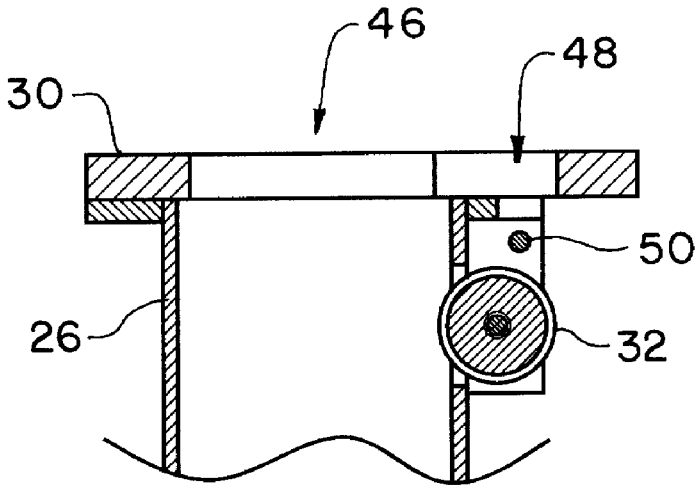
FIG. 5 is a partially sectioned cross sectional view of the top of a typical mast section.
Figure 6:
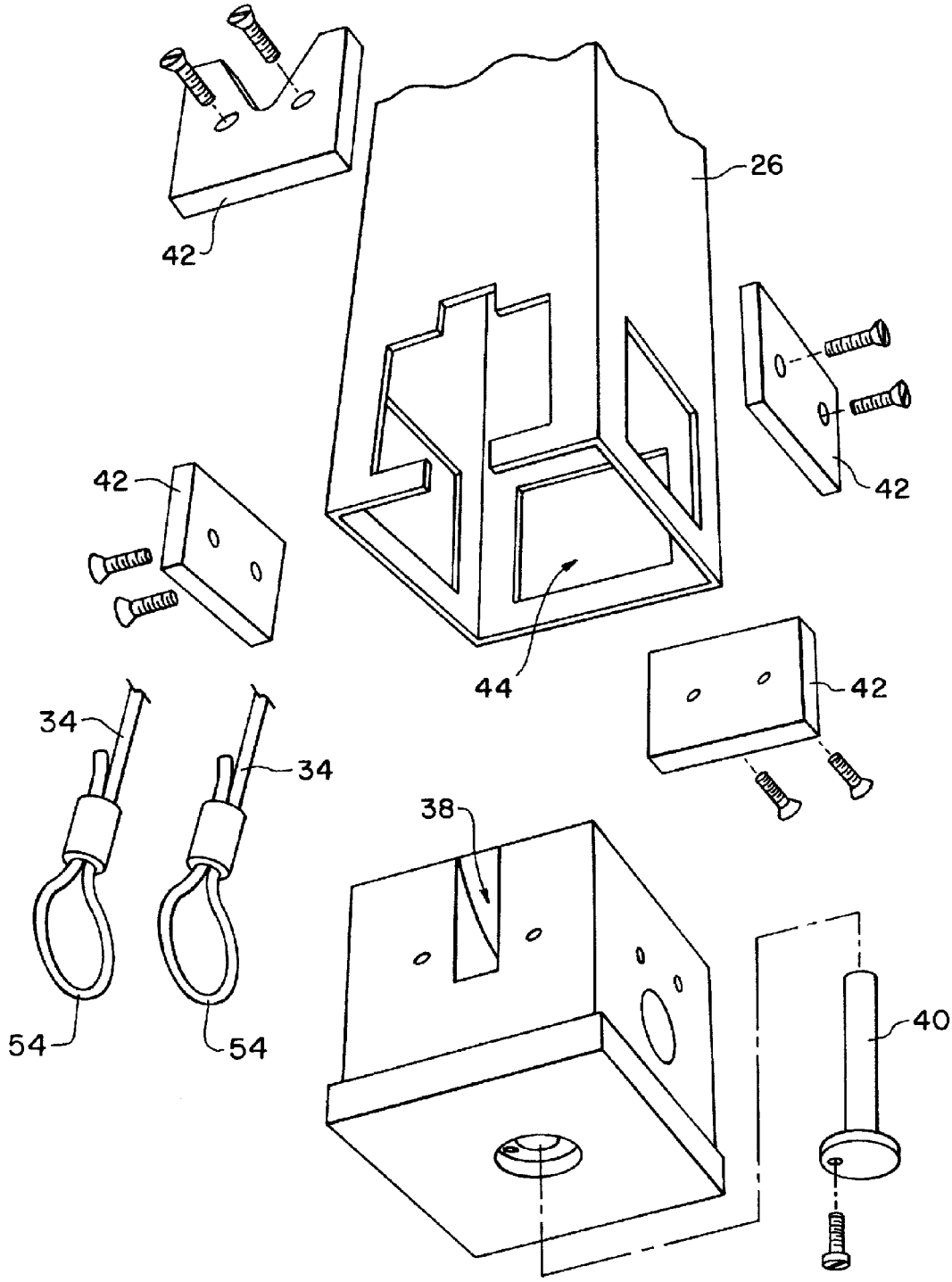
FIG. 6 is a perspective exploded view of a pull block assembly utilized in the mast system of FIGS. 1-5.

Now, additionally referring to FIGS. 4-6, a head bearing 30 is atop each mast section except the last mast section, to which a payload is typically mounted. Head bearing 30 is a friction reducing block and may be made of an oil-impregnated nylon to reduce the frictional contact as the section that is nested therein is guided through head bearing 30. Head bearing 30 may substantially surround a subsequently nested section and may have slots and relief sections built therein to accommodate the mechanisms of the assembly.

The top of each section, except for the inner most nested section, a cable sheave 32 is mounted to accommodate, in a rolling fashion, a cable 34. Cable 34 has a loop that is attached to a pull block assembly 28, the cable being subsequently routed over cable sheave 32 and is connected to the next outer mast section, except for the first nested section in which the cable is routed to either winch system 20 or manual erecting system 22. Cable 34 is captivated in pull block assembly 28 having a loop 54 type of arrangement in cable 34 with another loop 54 arrangement at the other end of cable 34. In an alternate arrangement, a double cable sheave having two grooves to accommodate two runs of cable 34 may be utilized in order to use a thinner cable or to provide more support. In this configuration, cable 34 is made approximately twice as long with both loops 54 being captivated by pull block assembly 28 and a midpoint of the cable, after running over the double grooved cable sheave, has a pin 50 inserted to captivate cable 34 to the next outermost mast section.

Extensible payload system 10 additionally includes a defrost system 36 having an opening and a coupling in the bottom of mast section 24 so that a coupling hose can be extended from the exhaust system of the vehicle to the coupling on mast section 24 to thereby allow the heat from the exhaust to be forced up through the mast system 14 to elevate the temperature sufficiently so that ice that may have formed thereon dissipates, or at least weakens, sufficiently to allow retraction of mast system 14 when it is desired to retract the system.

Pull block assembly 28 additionally includes a cable receiving opening 38, a captivating pin 40 and shims 42 that are attached to pull block 28 through openings 44 in mast section 26. Head bearing 30 includes a nested mast opening 46 and cable openings 48 through which cable 34 passes and operates. Proximate to head bearing 30, cable pin 50 extends through a loop or midpoint of cable 34 from the next innermost nested mast section. Proximate to head bearing 30 or attached thereto are routing loops 52 for routing of a cable that extends to the payload mounted to the top of mast system 14. Routing loops 52 provide for the orderly extension of cable that is associated with the payload and may carry electrical signals and/or power thereto.

Cable receiving opening 38 of pull block assembly 28 has a curved feature against which cable 34 rests while cable 34 is under tension. Cable receiving opening 38 accommodates the size of cable 34 and has a captivating pin 40 that extends through another opening into cable receiving opening 38 to thereby captivate cable 34. Captivating pin 40, while illustrated as entering the bottom of pull block assembly 28 can also be embodied in which a pin is inserted through the side of pull block assembly 28 through the hole in the side thereof. This type of arrangement would allow shims 42 to hold captivating pin 40 in position. Shims 42 are mounted through openings in mast section 26 to pull block 28 thereby captivating pull block 28 to mast section 26. Shims 42 provide bearing surfaces as well as provide for the centering or positioning of an outer wall of mast section 26 away from an inner wall of mast section 24. Shims 42 thereby coact to space the mast section from the next outermost mast section, provide a friction reduced bearing surface and to retain the pull block assembly 28 to the bottom of the mast section. The combination of head bearing 30 and shims 42 act to keep mast system 14 in line and to allow for a robust easily extendible system.

As can be seen in FIG. 4, two openings are provided for the routing of cables, one of which may accommodate erecting winch system 20 and the other to accommodate the bac-up cables for the redundancy system. Additionally, it is also contemplated to have more than one cable run to a pull block assembly 28, which can have additional openings to accommodate more than one cable that could still be captivated by a single captivating pin 40. Mast opening 46 and head bearing 30 are sized and positioned to prevent contact between the outer surface of the nested section and the inner surface of the nesting section. As can be seen in FIG. 4, head bearing 30 substantially surrounds the nested section particularly providing positional spacing at the corners of the nested section.

Although not specifically illustrated, there are positioned along the nesting sections various sensors that sense the amount that mast system 14 has been extended in order to reduce the speed and stop the extension thereof as the nested mast moves to a fully extended position. Additionally, the sensors reduce the lowering speed as mast system 14 reaches its fully nested position. Although not illustrated, buffer blocks or springs may be mounted to the bottom of each mast section to eliminate or reduce the shock of any rapid descent of mast system 14 in emergency situations when mast system 14 has to be rapidly de-extended or re-nested.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An extensible payload system, comprising:

mounting equipment; and a mast system removably coupled to said mounting equipment, said mast system including:

a plurality of nested mast sections including a first mast section and a second mast section nested within said first mast section;

at least one cable rollably coupled to said first mast section; and a pull block assembly coupled to an end of said second mast section, said pull block assembly having a cable receiving opening, said cable being routed into said cable receiving opening and being coupled to said pull block assembly, said pull block assembly including a captivating pin, said cable having a loop on each end thereof, said captivating pin extending through both of said loops.

2. The payload system of claim 1, wherein said second mast section includes a double cable sheave over which said cable moves.

3. The payload system of claim 2, wherein said plurality of nested mast sections further include a third mast section within which said first mast section is nested, said third mast section includes a cable coupling to which said cable is coupled at approximately a midpoint between said loop and said other loop.

4. The payload system of claim 1, further comprising a plurality of shims connected to said pull block assembly.

5. The payload system of claim 4, wherein said shims are positioned to space said second mast section from said first mast section.

6. The payload system of claim 5, wherein said shims retain said pull block assembly to said second mast section.

7. The payload system of claim 1, wherein said mast system further includes a head bearing block connected to an end of said first mast section, said head bearing block substantially covering said end.

8. The payload system of claim 7, wherein said first mast section has an inner wall, said second mast section having an outer wall, said head bearing block being configured to space said outer wall and said inner wall apart from each other.

9. The payload system of claim 1, further comprising a deicing system including a coupling on said mast system that can be connected to an exhaust system of a vehicle, said deicing system configured to device the payload system by way of heated exhaust from the exhaust system.

10. The payload system of claim 1, further comprising at least one erecting system connected to said first mast section, said at least one erecting system also coupled to said cable

11. A mast system, comprising:

a plurality of nested mast sections including a first mast section and a second mast section nested within said first mast section;

at least one cable rollably coupled to said first mast section; and a pull block assembly coupled to an end of said second mast section, said pull block assembly having a cable receiving opening, said cable being routed into said cable receiving opening and being coupled to said pull block assembly, said pull block assembly including a captivating pin, said cable having a first loop on a first end of said cable and a second loop on a second end of said cable, said captivating pin extending through said first loop and through said second loop.

12. The mast system of claim 11, wherein said second mast section includes a double cable sheave over which said cable moves.

13. The mast system of claim 12, wherein said plurality of nested mast sections further include a third mast section within which said first mast section is nested, said third mast section includes a cable coupling to which said cable is coupled at approximately a midpoint between said loop and said other loop.

14. The mast system of claim 11, further comprising a plurality of shims connected to said pull block assembly.

15. The mast system of claim 14, wherein said shims are positioned to space said second mast section from said first mast section, said shims being configured to retain said pull block assembly to said second mast section.

16. The mast system of claim 11, further comprising a head bearing block connected to an end of said first mast section, said head bearing block substantially covering said end, said first mast section having an inner wall, said second mast section having an outer wall, said head bearing block being configured to space said outer wall and said inner wall apart from each other.

* * * * *